US011371470B2

(12) United States Patent
Asanuma

(10) Patent No.: US 11,371,470 B2
(45) Date of Patent: Jun. 28, 2022

(54) EVAPORATED FUEL TREATMENT APPARATUS

(71) Applicant: AISAN KOGYO KABUSHIKI KAISHA, Obu (JP)

(72) Inventor: Daisaku Asanuma, Gamagori (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/435,089

(22) PCT Filed: Nov. 25, 2019

(86) PCT No.: PCT/JP2019/045916

§ 371 (c)(1),
(2) Date: Aug. 31, 2021

(87) PCT Pub. No.: WO2020/179150

PCT Pub. Date: Sep. 10, 2020

(65) Prior Publication Data

US 2022/0136462 A1 May 5, 2022

(30) Foreign Application Priority Data

Mar. 1, 2019 (JP) ..... JP2019-037107
May 29, 2019 (JP) ..... JP2019-100097

(51) Int. Cl.
*F02D 41/18* (2006.01)
*F02M 25/08* (2006.01)
*F01M 13/02* (2006.01)

(52) U.S. Cl.
CPC ..... *F02M 25/08* (2013.01); *F01M 13/022* (2013.01); *F02D 41/18* (2013.01);
(Continued)

(58) Field of Classification Search
CPC .... F02D 41/0037; F02D 41/004; F02D 41/18; F02D 41/185; F02D 41/187; F02M 25/0809; F02M 25/0827
(Continued)

(56) References Cited

U.S. PATENT DOCUMENTS 10,378,469 B2 * 8/2019 Insixiengmai ..... F02M 25/0836
11,174,765 B2 * 11/2021 Sekiguchi ..... F02M 35/10157
(Continued)

FOREIGN PATENT DOCUMENTS

JP H08-135522 A 5/1996
JP H11-343925 A 12/1999
(Continued)

OTHER PUBLICATIONS

Feb. 4, 2020 International Search Report issued in International Patent Application No. PCT/JP2019/045916.
(Continued)

*Primary Examiner* — Erick R Solis
(74) *Attorney, Agent, or Firm* — Oliff PLC

(57) ABSTRACT

An evaporated fuel treatment apparatus includes an abnormality determination unit that determines an abnormality of a purge passage. The abnormality determination unit changes an operating cycle of a purge control valve to a cycle longer than an initial set value while maintaining a duty ratio of the purge control valve set according to an operating state of an internal combustion engine, and determines an abnormality of the purge passage based on a first variation range and a second variation range calculated from a detection value detected by an airflow meter before and after the change of the operating cycle.

10 Claims, 8 Drawing Sheets

(52) U.S. Cl.
CPC ..... *F02D 41/185* (2013.01); *F02D 41/187* (2013.01); *F02M 25/0809* (2013.01); *F02M 25/0827* (2013.01); *F01M 2013/027* (2013.01)

(58) Field of Classification Search
USPC ..... 123/520; 73/114.32, 114.34, 114.39
See application file for complete search history.

(56) References Cited

U.S. PATENT DOCUMENTS

| | | | | |
|---|---|---|---|---|
| 11,242,814 | B2 * | 2/2022 | Muto | F02D 41/22 |
| 2006/0179928 | A1 * | 8/2006 | Shikama | F02M 25/0809 73/114.38 |
| 2015/0025781 | A1 * | 1/2015 | Pearce | F02D 41/0032 701/114 |
| 2018/0045143 | A1 * | 2/2018 | Dudar | F02M 37/0076 |
| 2018/0291830 | A1 | 10/2018 | Kurosawa et al. | |

FOREIGN PATENT DOCUMENTS

| | | | |
|---|---|---|---|
| JP | 2017-78378 | A | 4/2017 |
| JP | 2017-129073 | A | 7/2017 |
| JP | 2018-141438 | A | 9/2018 |

OTHER PUBLICATIONS

Aug. 25, 2021 International Preliminary Report on Patentability issued in International Patent Application No. PCT/JP2019/045916.

* cited by examiner

FIG. 3

XX: PUMP ROTATION SPEED

| Duty \ XX | 30,000 | 40,000 |
|---|---|---|
| 0 | 0.2 | 0.3 |
| 20 | 0.3 | 0.4 |
| 40 | 0.4 | 0.5 |

[g/sec]

FIG. 4

XX: PUMP ROTATION SPEED

| Duty \ XX | 30,000 | 40,000 |
|---|---|---|
| 0 | 1.2 | 1.3 |
| 20 | 1.3 | 1.4 |
| 40 | 1.4 | 1.5 |

[Times]

EVAPORATED FUEL TREATMENT APPARATUS

CROSS-REFERENCE TO RELATED APPLICATIONS

This is a US national phase application based on the PCT International Patent Application No. PCT/JP2019/045916 filed on Nov. 25, 2019, and claiming the priority to Japanese Patent Applications No. 2019-037107 filed on Mar. 1, 2019 and No. 2019-100097 filed on May 29, 2019, the entire contents of which are incorporated by reference herein.

TECHNICAL FIELD

The present disclosure relates to an evaporated fuel treatment apparatus for supplying and treating an evaporated fuel generated in a fuel tank to an internal combustion engine.

BACKGROUND ART

In an evaporated fuel treatment apparatus, in case an abnormality occurs, such as clogging of or leakage in a passage, evaporated fuel may escape into the atmosphere. For detection of the occurrence of such an abnormal situation, it is required to determine whether the passage has an abnormality.

For example, such an evaporated fuel treatment apparatus configured to determine the abnormality of a passage is described in Patent Document 1. This evaporated fuel treatment apparatus determines the abnormality of a purge passage based on a change in a detection value of an airflow meter by varying a duty ratio of a purge control valve placed in the purge passage. Further, in an evaporated fuel treatment apparatus described in Patent Document 2, the abnormality determination of a purge passage (leak detection) is performed based on a change in a detection value of an airflow meter when a purge pump is driven after an ignition is turned off.

RELATED ART DOCUMENTS

Patent Documents

Patent Document 1: Japanese unexamined patent application publication No. 2018-141438

Patent Document 2: Japanese unexamined patent application publication No. 2017-129073

SUMMARY OF INVENTION

Problems to be Solved by the Invention

In the evaporated fuel treatment apparatus described in Patent Document 1, however, the duty ratio of the purge control valve is changed during execution of abnormality determination and thus the purge control valve is not controlled at a duty ratio appropriate to the operating state of an engine. This may cause fluctuations of an air-fuel ratio (A/F) and eventually deteriorate the accuracy of detecting the abnormality of the purge passage. On the other hand, in the evaporated fuel treatment apparatus described in Patent Document 2, the purge pump is driven only to detect the abnormality of the purge passage. This may cause deterioration of fuel efficiency, and also may cause release of evaporated fuel into the atmosphere if a leakage occurs in the purge passage.

The present disclosure has been made to address the above problems and has a purpose to provide an evaporated fuel treatment apparatus capable of accurately determining the abnormality of the purge passage and preventing deterioration of fuel efficiency and release of evaporated fuel into the atmosphere.

Means of Solving the Problems

To achieve the above purpose, one aspect of the present disclosure provides an evaporated fuel treatment apparatus comprising: an airflow meter provided in an intake passage connected to an internal combustion engine; a vapor passage connected to a fuel tank; a canister that stores evaporated fuel to be fed from the fuel tank to the vapor passage; a purge passage connected to the intake passage and the canister; a purge pump provided in the purge passage; and a purge control valve provided in a downstream side of the purge pump, wherein the evaporated fuel treatment apparatus includes an abnormality determination unit configured to determine an abnormality of the purge passage, and the abnormality determination unit is configured to change an operating cycle of the purge control valve to a longer cycle than an initial set value while maintaining a duty ratio of the purge control valve set according to an operating state of the internal combustion engine, and determine whether the abnormality exists in the purge passage based on a first variation range and a second variation range which are calculated from detection values detected by the airflow meter before and after the operating cycle is changed.

As the operating cycle of the purge control valve is set longer, the purge control valve is open for a longer time. If the purge passage is normal, accordingly, the purge gas flowing into the intake passage increases as compared with at an initially-set operating cycle. Thus, the amount of air flowing into the intake passage is decreased by just that increased amount of the purge gas. This results in that, in the variation ranges calculated from the detection values detected by the airflow meter, the second variation range is larger than the first variation range. On the other hand, if the abnormality, such as leakage or clogging, exists in the purge passage, the purge gas hardly flows into the intake passage, so that the amount of air flowing into the intake passage is hardly changed. This results in that, in the variation ranges calculated from the detection values detected by the airflow meter, the first variation range and the second variation range are almost not different. Consequently, based on the first variation range and the second variation range before and after the operating cycle is changed, it is possible to determine whether the purge passage is abnormal or not.

To be concrete, in the foregoing evaporated fuel treatment apparatus, the abnormality determination unit may be configured to determine that the abnormality exits in the purge passage when a difference between the second variation range and the first variation range is smaller than a first determination value.

Alternatively, in the foregoing evaporated fuel treatment apparatus, the abnormality determination unit may be configured to determine that the abnormality exits in the purge passage when a value obtained by dividing the second variation range by the first variation range is smaller than a second determination value.

In the foregoing evaporated fuel treatment apparatus, it is determined whether the abnormality exists in the purge passage while maintaining the duty ratio of the purge control valve set according to the operating state of the internal combustion engine. Thus, the air-fuel ratio (A/F) is less likely to fluctuate. Therefore, the present apparatus can accurately determine whether the purge passage is abnormal. Further, since whether the purge passage is abnormal is determined according to the original purge timing, it is possible to prevent deterioration of fuel efficiency and release of evaporated fuel to the outside.

In the foregoing evaporated fuel treatment apparatus, the abnormality determination unit may be configured to calculate the first variation range obtained before change of the operating cycle from a detection value detected by the airflow meter during opening or during closing of the purge control valve.

The first variation range can also be obtained not only while the purge control valve is open (i.e., during execution of purge) but also while the valve is closed, that is, during purge cut.

In the foregoing evaporated fuel treatment apparatus, the abnormality determination unit may be configured to calculate the second variation range obtained after change of the operating cycle from a detection value detected by the airflow meter by setting a guard value of a duty ratio of the purge valve and setting the operating cycle 1.5 to 2.5 times longer than the initial set value.

Since the second variation range is obtained in the above manner, when the purge passage is normal, the second variation range is reliably larger than the first variation range. This configuration can prevent erroneous determination of the abnormality of the purge passage and thus whether the purge passage is abnormal can be accurately determined.

In the foregoing evaporated fuel treatment apparatus, preferably, the abnormality determination unit is configured to decide the first determination value or the second determination value based on a duty ratio of the purge control valve and a rotation speed of the purge pump.

The apparatus configured as above determines the first determination value and the second determination value according to the state of purge, with the result that the accuracy of determining the abnormality of the purge passage can be enhanced.

Another aspect of the present disclosure to solve the above purpose provides an evaporated fuel treatment apparatus comprising: an airflow meter provided in an intake passage connected to an internal combustion engine; a vapor passage connected to a fuel tank; a canister that stores evaporated fuel to be fed from the fuel tank to the vapor passage; a purge passage connected to the intake passage and the canister; a purge pump provided in the purge passage; and a purge control valve provided in a downstream side of the purge pump, wherein the evaporated fuel treatment apparatus includes an abnormality determination unit configured to determine an abnormality of the purge passage, and the abnormality determination unit is configured to determine whether the abnormality exists in the purge passage based on a difference between a variation cycle of a detection value detected by the airflow meter and an operating cycle of the purge control valve while maintaining a duty ratio of the purge control valve set according to an operating state of the internal combustion engine.

When the abnormality, such as leakage or clogging, does not exist in the purge passage, that is, the purge passage is normal, the amount of air flowing into the intake passage changes according to the opening/closing operation of the purge control valve. Thus, the variation cycle of the detection value detected by the airflow meter is matched with or substantially approximate to the operating cycle of the purge control valve. On the other hand, if the abnormality, such as leakage or clogging, exists in the purge passage, the purge gas hardly flows into the intake passage and thus the amount of air flowing into the intake passage according to the opening/closing operation of the purge control valve does not change. This results in a difference between the variation cycle of the detection value detected by the airflow meter and the operating cycle of the purge control valve. Consequently, whether the purge passage is abnormal can be determined based on the difference between the variation cycle of the detection value detected by the airflow meter and the operating cycle of the purge control valve.

In the above-described evaporated fuel treatment apparatus, it is determined whether the purge passage is abnormal while maintaining the duty ratio of the purge control valve set according to the operating state of the internal combustion engine, so that the air-fuel ratio (A/F) is less likely to fluctuate. Therefore, whether the purge passage is abnormal can be determined with high precision. Further, since the purge passage is determined to be abnormal or not according to the original purge timing, so that deterioration of fuel efficiency or release of evaporated fuel to the atmosphere can be prevented.

In the foregoing evaporated fuel treatment apparatus, furthermore, preferably, the variation cycle is an average value of the variation cycle within a predetermined time.

Since the average value of the variation cycles within a predetermined time is used as the variation cycle as above, it is possible to determine whether the purge passage is abnormal while being less affected by the frequency change of the detection value detected by the airflow meter due to disturbance.

Effects of the Invention

According to the present disclosure, there can be provided an evaporated fuel treatment apparatus capable of accurately determining whether a purge passage is abnormal and also preventing deterioration of fuel efficiency and release of evaporated fuel into the atmosphere.

BRIEF DESCRIPTION OF THE DRAWINGS

FIG. 3 shows one example of a map to determine a determination value;

FIG. 4 shows one example of a map to determine a determination value in a modified example;

MODE FOR CARRYING OUT THE INVENTION

A detailed description of an embodiment of an evaporated fuel treatment apparatus according to the present disclosure will now be given referring to the accompanying drawings. The following embodiments describe that the evaporated fuel treatment apparatus of the present disclosure is applied to an engine system mounted in a vehicle such as a car.

<Overall System Configuration>

Figure 1:
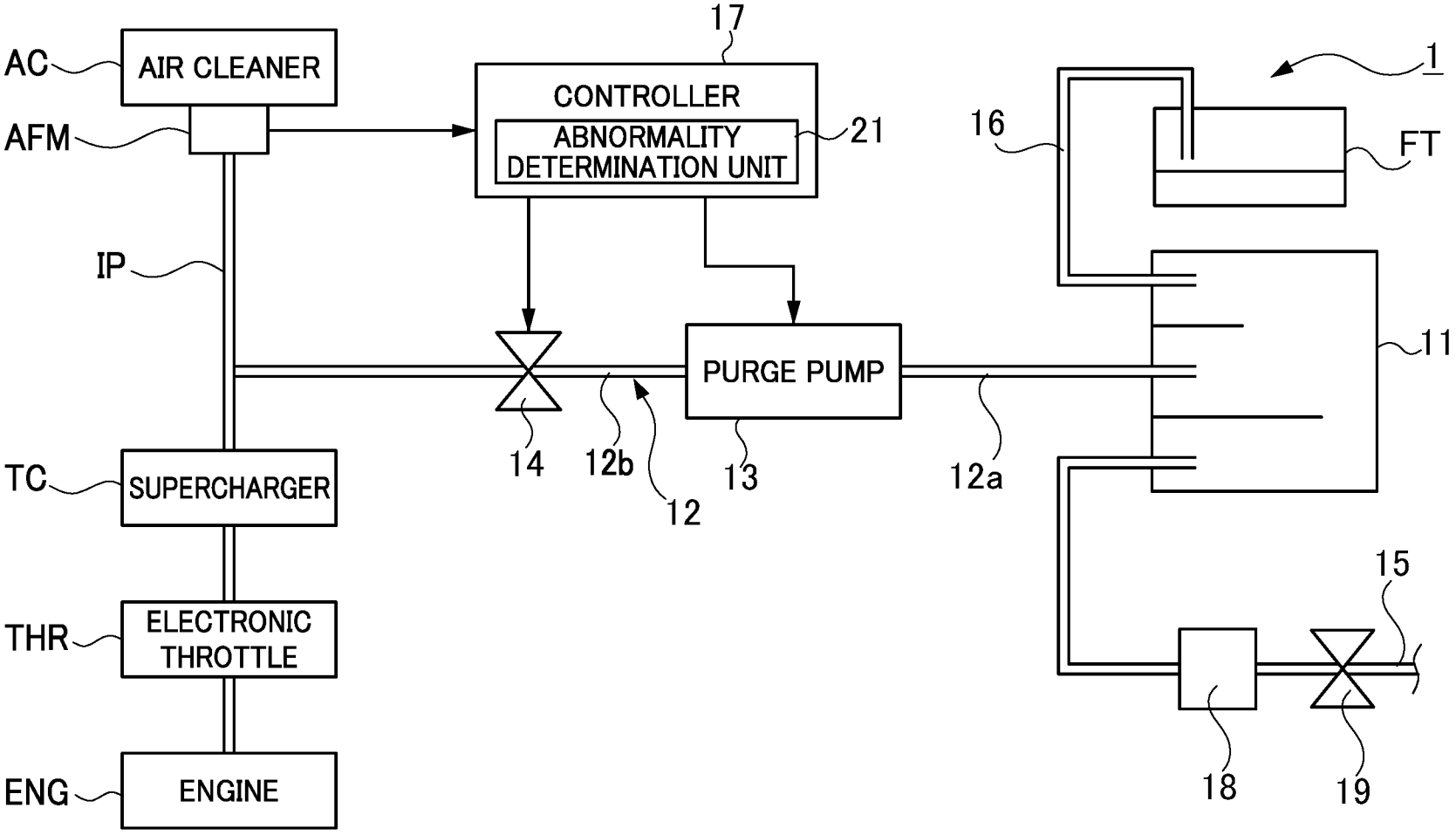
FIG. 1 is a schematic diagram showing the overall configuration of an engine system including an evaporated fuel treatment apparatus.

An engine system to which an evaporated fuel treatment apparatus 1 in the present embodiment is applied is to be mounted in a vehicle such as a car and is provided with an engine ENG as shown in FIG. 1. This engine ENG is connected to an intake passage IP for supplying air (intake air, suction air) to the engine ENG. In the intake passage IP, there are provided an electronic throttle THR (a throttle valve) for controlling the amount of air (intake air amount) flowing into the engine ENG by opening and closing the intake passage IP, and a supercharger TC for increasing the density of air that flows into the engine ENG. An air cleaner AC for removing foreign substances from the air flowing into the intake passage IP is provided on an upstream side of the electronic throttle THR, i.e., on the upstream side in a flowing direction of the intake air, in the intake passage IP. In the intake passage IP, accordingly, the air is sucked toward the engine ENG after passing through the air cleaner AC. An airflow meter AFM is provided downstream of the air cleaner AC. This airflow meter AFM detects the amount of air introduced into the intake passage IP from the atmosphere through the air cleaner AC. A detection signal of the airflow meter AFM is input to a controller 17 (an abnormality determination unit 21) described later.

The evaporated fuel treatment apparatus 1 in the present embodiment is configured to supply evaporated fuel from a fuel tank FT to the engine ENG through the intake passage IP in the above-configured engine system. This evaporated fuel treatment apparatus 1 includes a canister 11, a purge passage 12, a purge pump 13, a purge control valve 14, an atmosphere passage 15, a vapor passage 16, the controller 17, a filter 18, an air shutoff valve 19, and others.

The canister 11 is connected to the fuel tank FT through the vapor passage 16 and is configured to temporarily store evaporated fuel that flows therein from the fuel tank FT through the vapor passage 16. The canister 11 is also connected to the purge passage 12 and the atmosphere passage 15.

The purge passage 12 is connected to the intake passage IP and the canister 11. Thus, purge gas (i.e., gas containing evaporated fuel) flowing out of the canister 11 is introduced into the intake passage IP by passing through the purge passage 12. In the example shown in FIG. 1, the purge passage 12 is connected to the intake passage IP at a position upstream of the supercharger TC. The purge passage 12 includes an upstream-side passage 12*a* located upstream of the purge pump 13 (i.e., located between the canister 11 and the purge pump 13) and a downstream-side passage 12*b* located downstream of the purge pump 13 (i.e., located between the purge pump 13 and the intake passage IP).

The purge pump 13 is provided in the purge passage 12 and is configured to control a flow of purge gas flowing through the purge passage 12. Specifically, the purge pump 13 feeds the purge gas from the canister 11 into the purge passage 12 and supplies the purge gas fed into the purge passage 12 to the intake passage IP.

The purge control valve 14 is provided on a downstream side of the purge pump 13 (i.e., on a downstream side in a flowing direction of purge gas during execution of the purge control), that is, at a position between the purge pump 13 and the intake passage IP. The purge control valve 14 opens and closes the purge passage 12. When the purge control valve 14 is closed (i.e., in a valve closed state), the purge gas in the purge passage 12 is stopped by the purge control valve 14 and thus does not flow into the intake passage IP. On the other hand, when the purge control valve 14 is opened (i.e., in a valve open state), the purge gas is allowed to flow to the intake passage IP.

The atmosphere passage 15 has one end that opens to the atmosphere and the other end that is connected to the canister 11 to allow communication of the canister 11 with the atmosphere. Air taken in from the atmosphere thus flows in the atmosphere passage 15. In this atmosphere passage 15, the filter 18 and the air shutoff valve 19 are provided. The filter 18 is configured to remove foreign substances from the atmosphere (air) flowing into the atmosphere passage 15. The air shutoff valve 19 is configured to open and close the atmosphere passage 15.

The vapor passage 16 is connected to the fuel tank FT and the canister 11. Thus, the evaporated fuel in the fuel tank FT is allowed to flow into the canister 11 through the vapor passage 16.

The controller 17 is a part of an ECU (not shown) mounted in a vehicle and is arranged integral with other parts of the ECU (e.g., a part for controlling the engine ENG). As an alternative, the controller 17 may be arranged separately from the other parts of the ECU. The controller 17 includes various memories, such as a CPU, a ROM, and a RAM. The controller 17 controls the evaporated fuel treatment apparatus 1 and the engine system according to programs stored in advance in the memories. For example, the controller 17 controls the purge pump 13 and the purge control valve 14. Further, the controller 17 also obtains an output signal (a detection result of the air amount) from the airflow meter AFM.

In the present embodiment, the controller 17 is provided with the abnormality determination unit 21. The abnormality determination unit 21 determines whether an abnormality (closing or leakage) exists or not in the purge passage 12 (concretely, the downstream-side passage 12*b* of the purge passage 12). The abnormality determination unit 21 may be provided separately to be independent of the controller 17.

In the evaporated fuel treatment apparatus 1 configured as above, when a purge condition is met during operation of the engine ENG, the controller 17 controls the purge pump 13 and the purge control valve 14, that is, opens the purge control valve 14 while driving the purge pump 13 to execute the purge control. This purge control is a control for introducing purge gas from the canister 11 into the intake passage IP through the purge passage 12.

While the purge control is being performed, the engine ENG is supplied with air sucked into the intake passage IP, fuel injected from the fuel tank FT through an injector (not shown), and purge gas supplied to the intake passage IP under the purge control. The controller 17 adjusts the injection time of the injector, the opening period of the purge control valve 14, and others to adjust the air-fuel ratio (A/F) of the engine ENG to an optimum air-fuel ratio (e.g., an ideal air-fuel ratio).

<Control Contents for Determining Abnormality of Purge Passage>

In the present embodiment, as an on-board diagnostic (OBD) of the vehicle, it is determined whether the downstream-side passage 12*b* of the purge passage 12 is abnormal or not.

Example 1

Figure 2:
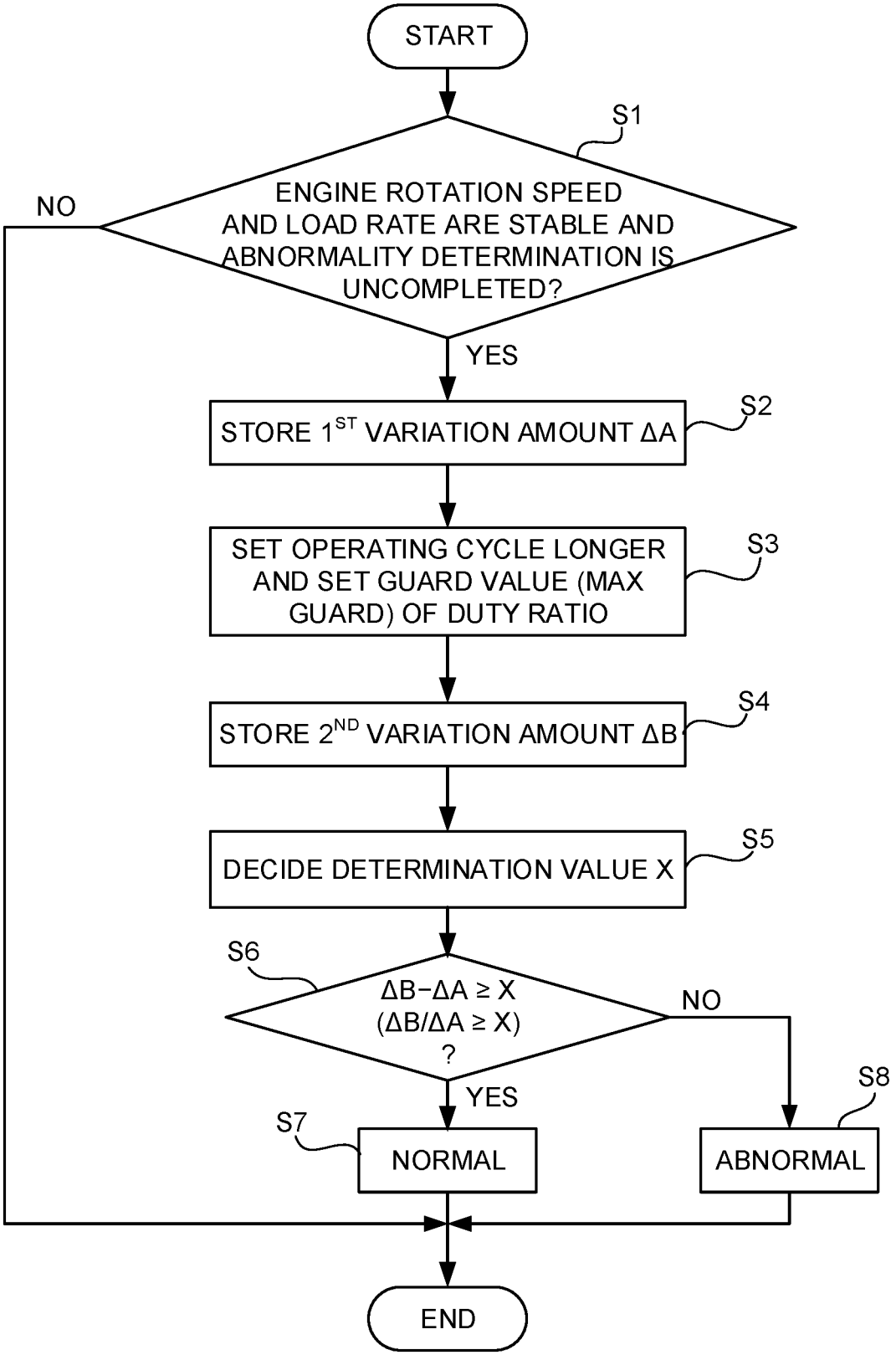
FIG. 2 is a control flowchart of abnormality determination in Example 1.

Specifically, in Example 1, the abnormality determination unit 21 of the controller 17 performs a control based on a control chart shown in FIG. 2. In other words, the abnormality determination unit 21 performs an abnormality determination control when the engine rotation speed and the engine load rate are stable and the abnormality determination is uncompleted (undetected by OBD) (step S1: YES). The abnormality determination unit 21 judges that the engine rotation speed and the engine load rate become stable when each variation of the engine rotation speed and the engine load rate falls within a fixed range for a fixed period of time. Accordingly, it is possible to determine whether the purge passage 12 is abnormal or not while maintaining the duty ratio of the purge control valve 14 set according to the operating state of the engine ENG. Thus, the air-fuel ratio (A/F) is less likely to fluctuate and hence the abnormality of the purge passage 12 can be determined accurately.

When the abnormality determination control starts to be performed, the abnormality determination unit 21 stores a first variation amount ΔA of the amount of intake air for a predetermined time (e.g., 1 to 2 seconds) output from the airflow meter AFM (step S2). The first variation amount ΔA is a difference between a maximum value (MAX) and a minimum value (MIN) each detected by the airflow meter AFM for the predetermined time, that is, an amplitude of the air amount. In the present embodiment, the first variation amount ΔA is stored when the purge control valve 14 is open (i.e., during execution of the purge control). Alternatively, the first variation amount ΔA may be stored when the purge control valve 14 is closed (i.e., during purge cut). Specifically, the first variation amount ΔA can also be obtained when the purge control valve 14 is closed, that is, during purge cut.

Next, the abnormality determination unit 21 sets the operating cycle of the purge control valve 14 to be longer than the initial set value and also sets a guard value (MAX guard) of the operating duty (step S3). It should be noted that the operating cycle of the purge control valve 14 may be set to be about 1.5 to 2.5 times longer than the initial set value. The guard value may be set to about 10% to 40%. In the present embodiment, the operating cycle is set to be 2 times (200 ms) the initial set value (100 ms) and the guard value of the duty ratio is set to 40%.

The abnormality determination unit 21 successively stores a second variation amount ΔB of the intake air amount for a predetermined time (e.g., 1 to 2 seconds) from the airflow meter (step S4). The second variation amount ΔB is a difference between a maximum value (MAX) and a minimum value (MIN) each detected by the airflow meter AFM for the predetermined time after the operating cycle of the purge control valve 14 is set longer, that is, an amplitude of the air amount.

The second variation amount ΔB obtained in the above manner is reliably larger than the first variation amount ΔA if the purge passage 12 (the downstream-side passage 12*b*) is normal. Thus, it is possible to prevent erroneous determination of the abnormality of the purge passage 12 (the downstream-side passage 12*b*), so that whether the purge passage 12 (the downstream-side passage 12*b*) is abnormal can be determined accurately.

Further, the abnormality determination unit 21 determines a determination value X for determining whether the purge passage 12 (the downstream-side passage 12*b*) is abnormal. This determination value X may be any predetermined value (a fixed value); however, in the present embodiment, the determination value X is decided according to the rotation speed of the purge pump 13 and the duty ratio of the purge control valve 14 (step S5). Specifically, as shown in FIG. 3, the determination value X is decided based on a two-dimensional map settled by the rotation speed of the purge pump 13 and the duty ratio of the purge control valve 14. The determination value X determined in the above manner is an optimum value according to the state of purge, so that the accuracy of determining whether the purge passage 12 is abnormal can be enhanced. It should be noted that optimal map data for calculating the determination value X may be obtained in advance by experiment according to the specification of the engine system (the evaporated fuel treatment apparatus 1).

When the difference in variation amount of the air amount (ΔB−ΔA) is equal to or larger than the determination value X (step S6: YES), the abnormality determination unit 21 determines the purge passage 12 (the downstream-side passage 12*b*) to have neither clogging nor leakage, that is, to be normal (step S7). Specifically, when neither clogging nor leakage exists in the purge passage 12 (the downstream-side passage 12*b*), if the operating cycle of the purge control valve 14 is set longer, the purge control valve 14 is open for a longer time. This increases the amount of purge gas allowed to flow into the intake passage IP. Thus, the amount of air flowing into the intake passage IP is decreased by just that increased amount of purge gas and hence the second variation amount ΔB becomes larger than the first variation amount ΔA. Accordingly, when the difference in variation amount (ΔB−ΔA) is equal to or larger than the determination value X, the abnormality determination unit 21 can determine that the purge passage 12 (the downstream-side passage 12*b*) has neither clogging nor leakage, i.e., has a normality.

When the difference in variation amount (ΔB−ΔA) is equal to or larger than the determination value X, as described above, the abnormality determination unit 21 determines the purge passage 12 (the downstream-side passage 12*b*) to have neither clogging nor leaking, i.e., to be normal.

In contrast, when the difference in variation amount (ΔB−ΔA) is smaller than the determination value X, the abnormality determination unit 21 determines that the purge passage 12 (the downstream-side passage 12*b*) to be clogged or leak, that is, to be abnormal (step S8). Specifically, when the purge passage 12 (the downstream-side passage 12*b*) is abnormal due to clogging or leakage, the purge gas hardly flows into the intake passage IP and accordingly the amount of air flowing into the intake passage IP hardly changes. Therefore, there is little difference between the first variation amount ΔA and the second variation amount ΔB. Accordingly, when the difference in variation amount (ΔB−ΔA) is smaller than the determination value X, the abnormality determination unit 21 can determine that the purge passage 12 (the downstream-side passage 12*b*) has clogging or leakage, i.e., has an abnormality.

When the difference in variation amount (ΔB−ΔA) is smaller than the determination value X, as described above, the abnormality determination unit 21 determines the purge passage 12 (the downstream-side passage 12*b*) to be clogging or leaking, i.e., to be abnormal.

In the evaporated fuel treatment apparatus 1 in the present embodiment, as described above, it is determined whether the purge passage 12 (the downstream-side passage 12*b*) is abnormal while maintaining the duty ratio of the purge control valve 14 set according to the operating state of the engine ENG. Thus, the air-fuel ratio (A/F) is less likely to fluctuate. The abnormality of the purge passage 12 (the downstream-side passage 12*b*) can therefore be determined with high accuracy. Furthermore, it is possible to determine whether the purge passage 12 (the downstream-side passage 12*b*) is abnormal according to the original purge timing, so that the apparatus can prevent deterioration of fuel efficiency and release of evaporated fuel to the atmosphere.

Herein, several modified examples will be briefly described below. In the foregoing embodiment, the abnormality of the purge passage 12 (the downstream-side passage 12*b*) is checked based on the difference between the first variation amount ΔA and the second variation amount ΔB (ΔB−ΔA). However, the abnormality of the purge passage 12 (the downstream-side passage 12*b*) may also be determined based on the ratio of the second variation amount ΔB to the first variation amount ΔA (ΔB/ΔA). In this case, the determination value X may be decided from a map shown in FIG. 4. Specifically, the abnormality determination unit 21 determines the determination value X based on the map shown in FIG. 4 at step S5 in FIG. 2. When the ratio of the second variation amount ΔB to the first variation amount ΔA (ΔB/ΔA) is equal to or larger than the determination value X in step S6 (S6: YES), the purge passage 12 (the downstream-side passage 12*b*) is determined to be normal (S7). When the ratio is smaller than the determination value X (S6: NO), the purge passage 12 (the downstream-side passage 12*b*) is determined to be abnormal (S8). Even when the abnormality determination is performed as above, it is possible to accurately determine whether the purge passage 12 (the downstream-side passage 12*b*) is abnormal, as in the foregoing embodiment, and further prevent deterioration of fuel efficiency and release of evaporated fuel to the atmosphere.

Figure 5:
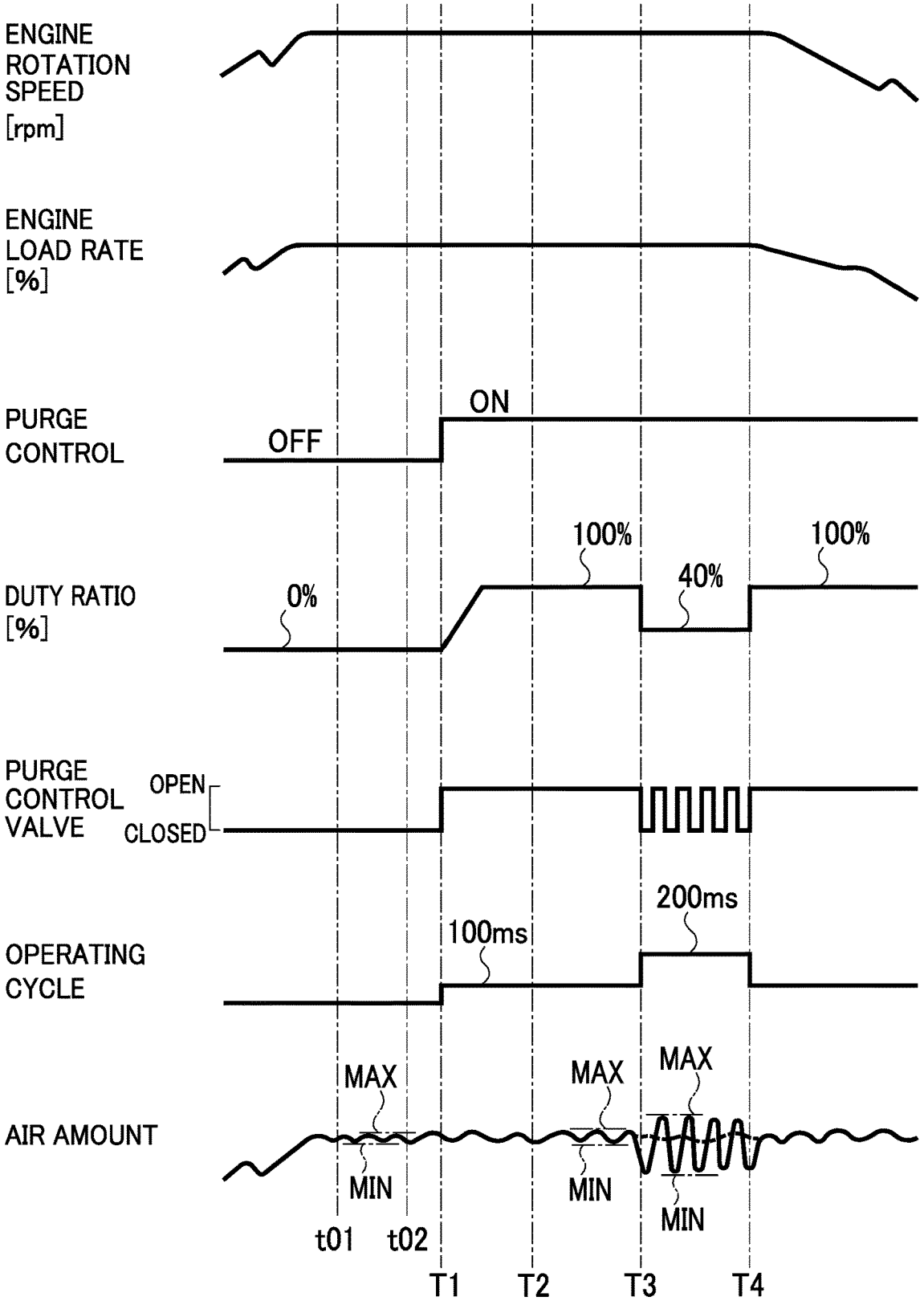
FIG. 5 shows one example of a control time chart in Example 1.

When the control is performed according to the control chart shown in FIG. 2, one example of a control time chart shown in FIG. 5 is executed. At time T1, as shown in FIG. 5, the purge control valve 14 is opened and the purge control is started. In a period from time T2 to time T3, the first variation amount ΔA is calculated from the maximum value (MAX) and the minimum value (MIN) of the air amount detected by the airflow meter AFM, and the calculated first variation amount ΔA is stored. As another example of the calculation method of the first variation amount ΔA, the first variation amount ΔA may be calculated from the maximum value (MAX) and the minimum value (MIN) of the air amount detected by the airflow meter AFM during purge cut (a period from time t01 to time t02) and stored.

At time T3, subsequently, the operating cycle of the purge control valve 14 is set longer (200 ms) than the initial set value (100 ms) and the guard value (40%) is set to the duty ratio. In a period from time T3 to T4, the second variation amount ΔB is calculated from the maximum value (MAX) and the minimum value (MIN) of the air amount detected by the airflow meter AFM and stored.

At time T4, when the difference (ΔB−ΔA) or the ratio (ΔB/ΔA) between the second variation amount ΔB and the first variation amount ΔA is equal to or larger than the determination value X (i.e., when the intake air amount greatly changes), it is determined that the purge passage 12 (the downstream-side passage 12*b*) is normal without clogging or leaking (a solid line in FIG. 5). On the other hand, when the difference (ΔB−ΔA) or the ratio (ΔB/ΔA) between the second variation amount ΔB and the first variation amount ΔA is smaller than the determination value X (i.e., when the intake air amount hardly changes), it is determined that the purge passage 12 (the downstream-side passage 12*b*) is abnormal due to clogging or leaking (a broken line in FIG. 5)

Example 2

Figure 6:
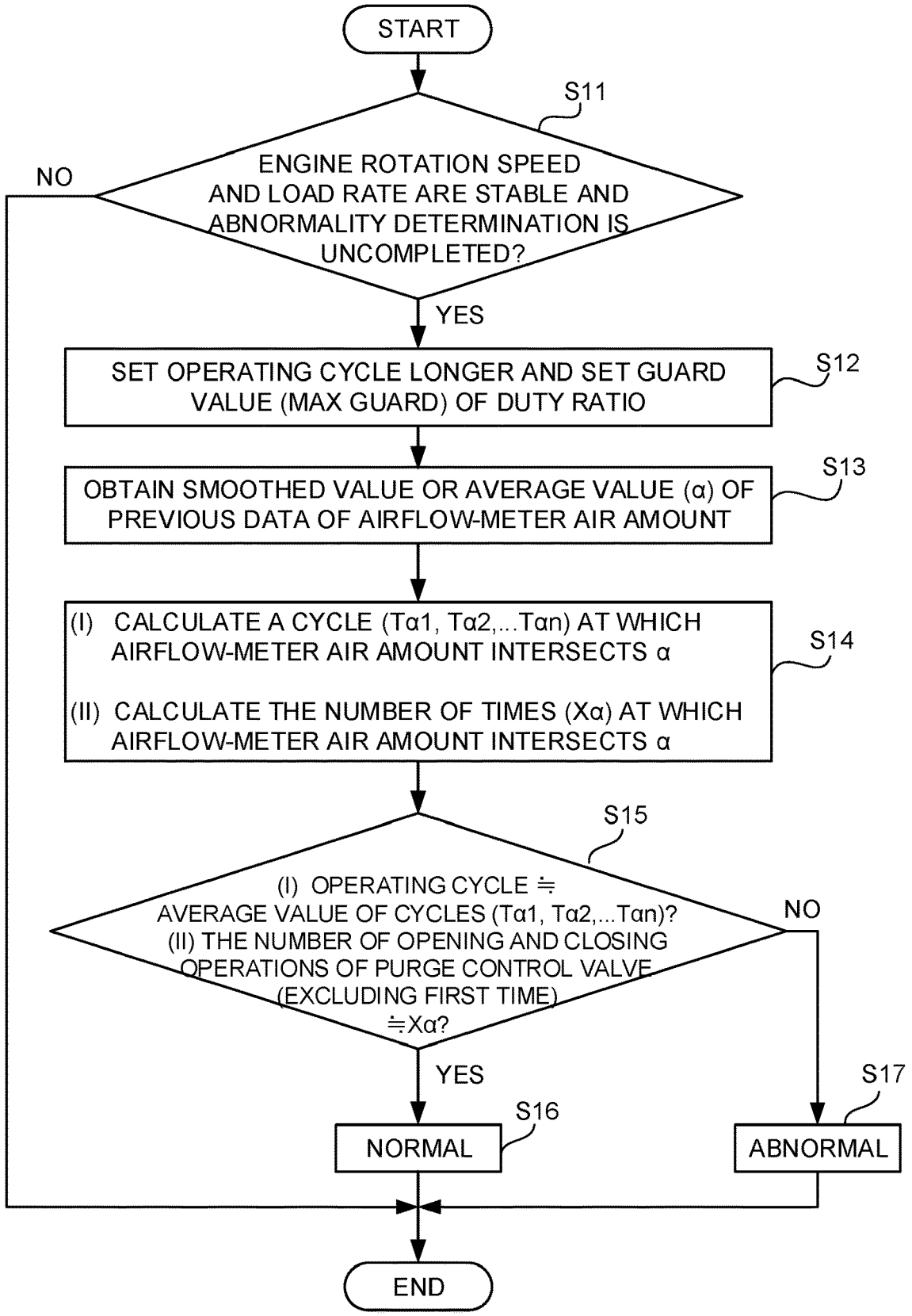
FIG. 6 is a control flowchart of abnormality determination in Example 2.

In Example 2, the abnormality determination unit 21 performs the control based on a control chart shown in FIG. 6. Specifically, the abnormality determination unit 21 performs the abnormality determination control when the engine rotation speed and the engine load rate are stable and the abnormality determination is uncompleted (undetected by OBD) (step S11: YES).

When the abnormality determination control starts to be performed, the abnormality determination unit 21 sets the operating cycle of the purge control valve 14 longer than the initial set value and also sets the guard value (MAX guard) to the duty ratio (step S12). The operating cycle of the purge control valve 14 may be set to be about 1.5 to 2.5 times longer than the initial set value. Further, the guard value may be set to about 10% to 50%. In this example, the operating cycle is set to be 2 to 2.5 times (200 to 250 ms) the initial set value (100 ms) and the guard value of the duty ratio is set to 50%. It is not necessarily required to extend the operating cycle of the purge control valve 14 (that is, to set the operating cycle longer than the initial set value); however, this extension is preferably performed in order to enhance the accuracy of determining whether the purge passage 12 (the downstream-side passage 12*b*) is abnormal.

Subsequently, the abnormality determination unit 21 obtains a smoothed value or an average value of previous data (hereinafter, referred to as a calculated value α) regarding the intake air amount detected by the airflow meter AFM (hereinafter, referred to as an airflow-meter air amount) (step S13).

The smoothing process is a process for calculating an airflow-meter air amount sm[N] smoothed this time from the following expression using a present airflow-meter air amount NI, an airflow-meter air amount sm[N−1] obtained in a previous processing, and the number of smoothing processes TN:

$$sm[N] \leftarrow sm[N-1]+(NI-sm[N-1])/TN \quad (1)$$

wherein N is an integer number equal to or greater than 2.

Figure 7:
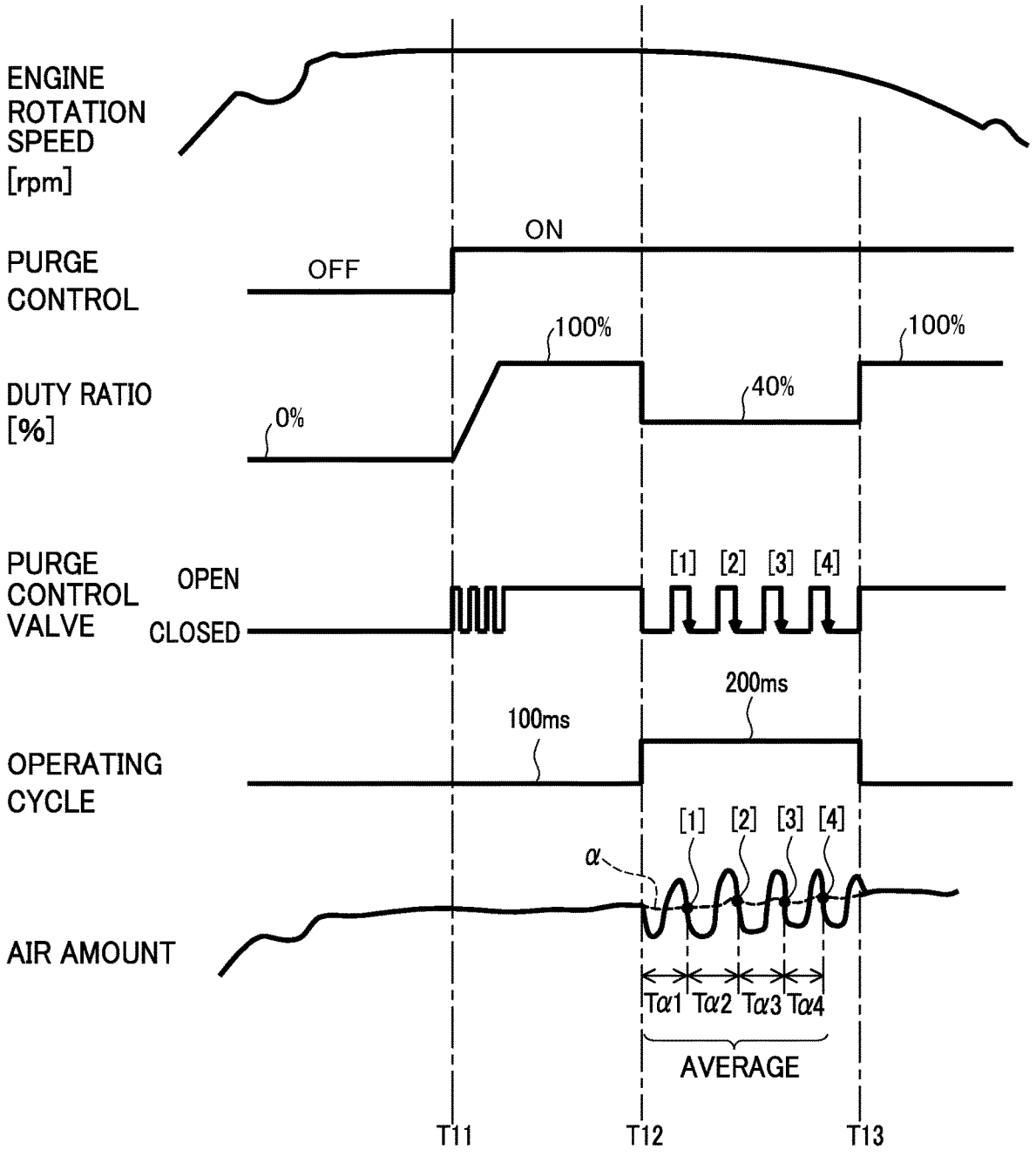
FIG. 7 shows one example of a control time chart in Example 2.

The abnormality determination unit 21 then calculates a cycle (Tα1, Tα2, . . . , Tαn) at which the airflow-meter air amount intersects the calculated value α ((I) in step S14). Herein, one example of the calculated value α and the cycle (Tα1, Tα2, . . . , Tαn) is shown in FIG. 7 which will be described later, in which n is an integer equal to or larger than 3 and is set to 4 in the example shown in FIG. 7. Further, the cycle (Tα1, Tα2, . . . , Tαn) is one example of a variation cycle in the present disclosure.

After calculation of the average value of the cycles (Tα1, Tα2, . . . , Tαn), when the operating cycle of the purge control valve 14 and the average value of the cycles (Tα1, Tα2, . . . , Tαn) are approximate to (that is, matched or substantially matched with) each other ((I) in step S15: YES), the abnormality determination unit 21 determines the purge passage 12 (the downstream-side passage 12*b*) to have neither clogging nor leakage, that is, to be normal (step S16). In other words, when neither clogging nor leakage exists in the purge passage 12 (the downstream-side passage 12*b*), the purge gas does not flow into the intake passage IP while the purge control valve 14 is closed (i.e., in a valve closed state), whereas the purge gas flows into the intake passage IP while the purge control valve 14 is open (i.e., in a valve open state). Thus, the airflow-meter air amount varies in sync with the opening and closing operations of the purge control valve 14. When the purge passage 12 (the downstream-side passage 12*b*) has neither clogging nor leakage, it is considered that the operating cycle of the purge control valve 14 and the average value of the cycles (Tα1, Tα2, . . . , Tαn) are approximate to each other. When the operating cycle of the purge control valve 14 and the average value of the cycles (Tα1, Tα2, . . . , Tαn) are approximate to each other, therefore, the abnormality determination unit 21 determines the purge passage 12 (the downstream-side passage 12*b*) to have neither clogging or leakage (i.e., to be normal).

As the case where the operating cycle of the purge control valve 14 and the average value of the cycles (Tα1, Tα2, . . . , Tαn) are approximate, there is a conceivable example where an average value of the cycles (Tα1, Tα2, . . . , Tαn) falls within a range of 0.8 to 1.2 times the operating cycle of the purge control valve 14. In this example, the case where the operating cycle of the purge control valve 14 and the average value of the cycles (Tα1, Tα2, . . . , Tαn) are approximate corresponds to when the average value of the cycles (Tα1, Tα2, . . . , Tαn) falls within a range of 180 ms to 220 ms while the operating cycle of the purge control valve 14 is 200 ms.

In contrast, when the operating cycle of the purge control valve 14 and the average value of the cycles (Tα1, Tα2, . . . , Tαn) are not approximate ((I) in step S15: NO), the abnormality determination unit 21 determines the purge passage 12 (the downstream-side passage 12*b*) to have clogging or leakage, that is, to be abnormal (step S17). Specifically, if the purge passage 12 (the downstream-side passage 12*b*) is abnormal due to clogging or leakage, even when the purge control valve 14 is in the valve open state, the purge gas hardly flows into the intake passage IP and thus the amount of air flowing into the intake passage IP hardly changes. This results in that a difference occurs between the operating cycle of the purge control valve 14 and the average value of the cycles (Tα1, Tα2, . . . , Tαn). Consequently, when the operating cycle of the purge control valve 14 and the average value of the cycles (Tα1, Tα2, . . . , Tαn) are not approximate, the abnormality determination unit 21 determines the purge passage 12 (the downstream-side passage 12*b*) to be clogged or leak (to be abnormal).

In the evaporated fuel treatment apparatus 1 in the present example, as described above, the abnormality determination unit 21 determines whether an abnormality exists in the purge passage 12 based on a difference between the variation cycle of the detection value detected by the airflow meter AFM and the operating cycle of the purge control valve 14. At this time, whether the abnormality exists in the purge passage 12 (the downstream-side passage 12*b*) is determined while the duty ratio of the purge control valve 14 set according to the operating state of the engine ENG is maintained, so that the air-fuel ratio (A/F) is less likely to fluctuate. This makes it possible to accurately determine whether the purge passage 12 (the downstream-side passage 12*b*) is abnormal. Since this abnormality determination on the purge passage 12 (the downstream-side passage 12*b*) is performed according to the original purge timing, the evaporated fuel treatment apparatus 1 can prevent deterioration of fuel efficiency and release of evaporated fuel to the atmosphere.

In the evaporated fuel treatment apparatus 1 in this example, the average value of the variation cycles of the airflow-meter air amount within a predetermined time is used as the variation cycle of the airflow-meter air amount. Specifically, the abnormality determination unit 21 determines whether the purge passage 12 (the downstream-side passage 12*b*) is abnormal or not based on a difference between the operating cycle of the purge control valve 14 and the average value of the cycles (Tα1, Tα2, . . . , Tαn). Thus, the evaporated fuel treatment apparatus 1 can determine whether the purge passage 12 (the downstream-side passage 12*b*) is abnormal while making it less likely to be affected by the frequency variation in the airflow-meter air amount due to external disturbance.

When the control is performed based on a control flowchart shown in FIG. 6, one example of a control time chart shown in FIG. 7 is performed. At time T11, as shown in FIG. 7, the purge control valve 14 is opened and the purge control is started. At time T12, the operating cycle of the purge control valve 14 is set longer (200 ms) than the initial set value (100 ms) and the guard value (40%) is set to the duty ratio.

In a period from time T12 to T13, subsequently, the purge control valve 14 is driven to open and close. At that time, when the operating cycle of the purge control valve 14 and the average value of the cycles (Tα1, Tα2, . . . , Tαn) are approximate to each other, the purge passage 12 (the downstream-side passage 12*b*) is determined to have neither clogging or leakage (i.e., to be normal). In contrast, when the operating cycle of the purge control valve 14 and the average value of the cycles (Tα1, Tα2, . . . , Tαn) are not approximate, the purge passage 12 (the downstream-side passage 12*b*) is determined to have clogging or leakage (i.e., to be abnormal).

Next, modified examples will be described. In a first modified example, the abnormality determination unit 21 calculates the number of times the airflow-meter air amount intersects the calculated value α (hereinafter, referred to as the intersecting number Xα) ((II) in step S14). Herein, the intersecting number Xα is the number of times the airflow-meter air amount intersects the calculated value α when the airflow-meter air amount changes from a maximum value (MAX) to a minimum value (MIN) or when the airflow-meter air amount changes from a minimum value (MIN) to a maximum value (MAX) for a predetermined time (that is, within the time in which the operating cycle of the purge control valve 14 is set longer than the initial set value). In the example shown in FIG. 7, the intersecting number Xα is for example the number of black points on a waveform of the airflow-meter air amount (that is, it is 4).

When the number of opening and closing operations of the purge control valve 14 (excluding the first time) and the intersecting number Xα are approximate to each other ((II) in step S15: YES), the abnormality determination unit 21 determines that it is normal (step S16). Specifically, when the purge passage 12 (the downstream-side passage 12*b*) has neither clogging nor leakage, the purge gas does not flow into the intake passage IP while the purge control valve 14 is in the valve closed state, whereas the purge gas flows into the intake passage IP while the purge control valve 14 is in the valve open state, so that the airflow-meter air amount varies in sync with the opening and closing operations of the purge control valve 14. When neither clogging nor leakage exists in the purge passage 12 (the downstream-side passage 12*b*), it is considered that the number of opening and closing operations of the purge control valve 14 and the intersecting number Xα are approximate to each other. When the number of opening and closing operations of the purge control valve 14 and the intersecting number Xα are approximate, therefore, the abnormality determination unit 21 determines the purge passage 12 (the downstream-side passage 12*b*) to have neither clogging nor leakage (i.e., to be normal).

The number of opening and closing operations of the purge control valve 14 is the number of times the purge control valve 14 changes from the open (or closed) state to the closed (or open) state for a predetermined period of time (that is, within the time in which the operating cycle of the purge control valve 14 is set longer than the initial set value).

In the foregoing example shown in FIG. 7, the number of opening and closing operations of the purge control valve 14 is 4.

As the case where the number of opening and closing operations of the purge control valve 14 and the intersecting number Xα are approximate to each other, there is a conceivable example where the intersecting number Xα falls within a range of 0.8 to 1.2 times the number of opening and closing operations of the purge control valve 14.

In contrast, when the number of opening and closing operations of the purge control valve 14 and the intersecting number Xα are not approximate ((II) in step S15: NO), the abnormality determination unit 21 determines the purge passage 12 (the downstream-side passage 12*b*) to have clogging or leakage, that is, to be abnormal (step S17). Specifically, if the purge passage 12 (the downstream-side passage 12*b*) is abnormal due to clogging or leakage, even when the purge control valve 14 is in the valve open state, the purge gas hardly flows into the intake passage IP and thus the amount of air flowing into the intake passage IP hardly changes. This results in that a difference occurs between the number of opening and closing operations of the purge control valve 14 and the intersecting number Xα. When number of opening and closing operations of the purge control valve 14 and the intersecting number Xα are not approximate to each other, therefore, the abnormality determination unit 21 determines the purge passage 12 (the downstream-side passage 12*b*) to be clogged or leak (i.e., to be abnormal).

Figure 8:
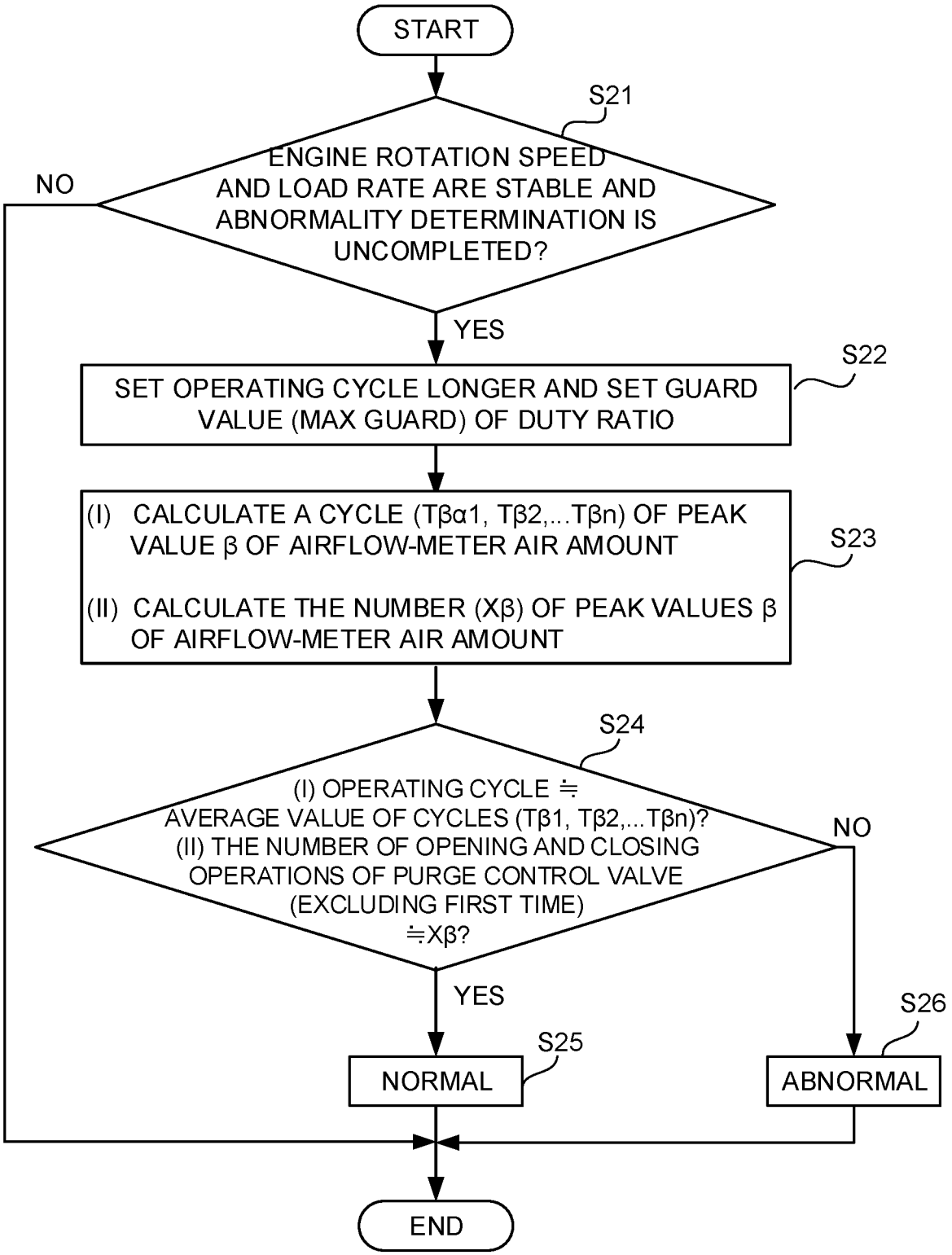
FIG. 8 is a control flowchart of abnormality determination in a modified example of Example 2.
Figure 9:
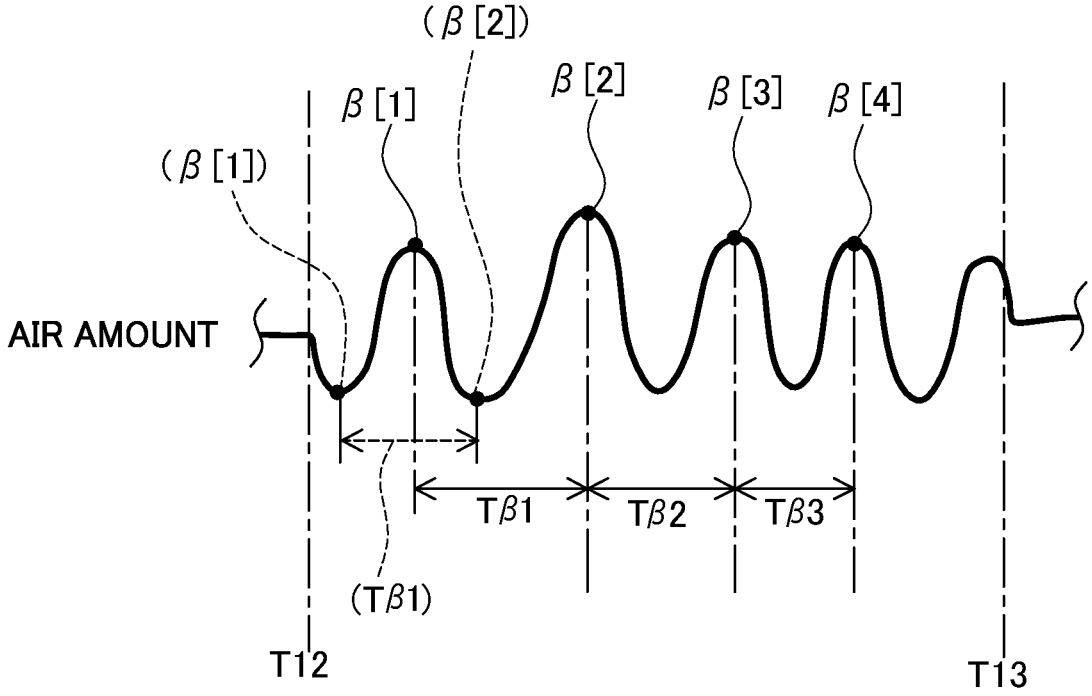
FIG. 9 is an explanatory view showing the cycle of peak value and the number of peaks in the modified example of Example 2.

In Example 2, as shown in FIG. 8, the abnormality determination unit 21 calculates the cycle (Tβ1, Tβ2, . . . Tβn) of a peak value β of the airflow-meter air amount ((I) in step S23), differently from FIG. 6. One example of this cycle (Tβ1, Tβ2, . . . Tβn) is shown in FIG. 9. Further, the cycle (Tβ1, Tβ2, . . . Tβn) is one example of a variation cycle in the present disclosure.

After calculation of the average value of the cycles (Tβ1, Tβ2, . . . Tβn), when the operating cycle of the purge control valve 14 and the average value of the cycles (Tβ1, Tβ2, . . . Tβn) are approximate to each other ((I) in step S24: YES), the abnormality determination unit 21 determines the purge passage 12 (the downstream-side passage 12*b*) to have neither clogging nor leakage, that is, to be normal (step S25). Specifically, when neither clogging nor leakage exists in the purge passage 12 (the downstream-side passage 12*b*), the purge gas does not flow into the intake passage IP while the purge control valve 14 is in the valve closed state, whereas the purge gas flows into the intake passage IP while the purge control valve 14 is in the valve open state, so that the airflow-meter air amount varies in sync with the opening and closing operations of the purge control valve 14. When the purge passage 12 (the downstream-side passage 12*b*) has neither clogging nor leakage, it is considered that the operating cycle of the purge control valve 14 and the average value of the cycles (Tβ1, Tβ2, . . . Tβn) are approximate to each other. When the operating cycle of the purge control valve 14 and the average value of the cycles (Tβ1, Tβ2, . . . Tβn) are approximate, therefore, the abnormality determination unit 21 determines the purge passage 12 (the downstream-side passage 12*b*) to have neither clogging nor leakage (i.e., to be normal).

As the case where the operating cycle of the purge control valve 14 and the average value of the cycles (Tβ1, Tβ2, . . . Tβn) are approximate, there is a conceivable example where the cycle (Tβ1, Tβ2, . . . Tβn) falls within a range of 0.8 to 1.2 times the operating cycle of the purge control valve 14.

In contrast, when the operating cycle of the purge control valve 14 and the average value of the cycles (Tβ1, Tβ2, . . . Tβn) are not approximate ((I) in step S24: NO), the abnormality determination unit 21 determines the purge passage 12 (the downstream-side passage 12*b*) to have clogging or leakage, that is, to be abnormal (step S26). Specifically, if the purge passage 12 (the downstream-side passage 12*b*) is abnormal due to clogging or leakage, the purge gas hardly flows into the intake passage IP and thus the amount of air flowing into the intake passage IP hardly changes. This results in that a difference occurs between the operating cycle of the purge control valve 14 and the cycle (Tβ1, Tβ2, . . . Tβn). When the operating cycle of the purge control valve 14 and the cycle (Tβ1, Tβ2, . . . Tβn) are not approximate to each other, therefore, the abnormality determination unit 21 determines the purge passage 12 (the downstream-side passage 12*b*) to be clogged or leak (i.e., to be abnormal).

In Example 3, as shown in FIG. 8, the abnormality determination unit 21 calculates the number of peak values β of the airflow-meter air amount (hereinafter, referred to as a peak number Xβ) ((II) in step S23), differently from FIG. 6.

When the number of opening and closing operations of the purge control valve 14 and the peak number Xβ are approximate to each other ((II) in step S24: YES), the abnormality determination unit 21 determines the purge passage 12 (the downstream-side passage 12*b*) to have neither clogging nor leakage, that is, to be normal (step S25). Specifically, when neither clogging nor leakage exists in the purge passage 12 (the downstream-side passage 12*b*), the purge gas does not flow into the intake passage IP while the purge control valve 14 is in the valve closed state, whereas the purge gas flows into the intake passage IP while the purge control valve 14 is in the valve open state, so that the airflow-meter air amount varies in sync with the opening and closing operations of the purge control valve 14. When the purge passage 12 (the downstream-side passage 12*b*) has neither clogging nor leaking, it is considered that the number of opening and closing operations of the purge control valve 14 and the peak number Xβ are approximate to each other. When the number of opening and closing operations of the purge control valve 14 and the peak number Xβ are approximate, therefore, the abnormality determination unit 21 determines the purge passage 12 (the downstream-side passage 12*b*) to have clogging nor leakage (i.e., to be normal).

As the case where the number of opening and closing operations of the purge control valve 14 and the peak number Xβ are approximate, there is a conceivable example where the peak number Xβ falls within a range of 0.8 to 1.2 times the number of opening and closing operations of the purge control valve 14.

In contrast, when the number of opening and closing operations of the purge control valve 14 and the peak number Xβ are not approximate ((II) in step S24: NO), the abnormality determination unit 21 determines the purge passage 12 (the downstream-side passage 12*b*) to have clogging or leakage, that is, to be abnormal (step S26). Specifically, when the purge passage 12 (the downstream-side passage 12*b*) is abnormal due to clogging or leakage, the purge gas hardly flows into the intake passage IP and thus the amount of air flowing into the intake passage IP hardly changes. This results in that a difference occurs between the number of opening and closing operations of the purge control valve 14 and the peak number Xβ. When the number of opening and closing operations of the purge control valve 14 and the peak number Xβ are not approximate to each other, therefore, the abnormality determination unit 21 determines the purge passage 12 (the downstream-side passage 12*b*) to be clogged or leak (i.e., to be abnormal).

The foregoing embodiments are mere examples and give no limitation to the present disclosure. The present disclosure may be embodied in other specific forms without departing from the essential characteristics thereof. For instance, in the foregoing embodiments, the evaporated fuel treatment apparatus of the present disclosure is applied to the engine system equipped with the supercharger TC. As an alternative, of course, the evaporated fuel treatment apparatus of the present disclosure may be applied to a naturally-aspirated engine system.

REFERENCE SIGNS LIST

1 Evaporated fuel treatment apparatus
11 Canister
12 Purge passage
12*b* Downstream-side passage
13 Purge pump
14 Purge control valve
16 Vapor passage
17 Controller
21 Abnormality determination unit
AFM Airflow meter
ENG Engine
FT Fuel tank
α Calculated value
(Tα1, Tα2, . . . , Tαn) Cycle
Xα Intersecting number
β Peak value
(Tβ1, Tβ2, . . . Tβn) Cycle
Xβ Peak number

The invention claimed is:

1. An evaporated fuel treatment apparatus comprising:
an airflow meter provided in an intake passage connected to an internal combustion engine;
a vapor passage connected to a fuel tank;
a canister that stores evaporated fuel to be fed from the fuel tank to the vapor passage;
a purge passage connected to the intake passage and the canister;
a purge pump provided in the purge passage; and
a purge control valve provided in a downstream side of the purge pump,
wherein the evaporated fuel treatment apparatus includes an abnormality determination unit configured to determine an abnormality of the purge passage, and
the abnormality determination unit is configured to change an operating cycle of the purge control valve to a longer cycle than an initial set value while maintaining a duty ratio of the purge control valve set according to an operating state of the internal combustion engine, and determine whether the abnormality exists in the purge passage based on a first variation range and a second variation range which are calculated from detection values detected by the airflow meter before and after the operating cycle is changed.

2. The evaporated fuel treatment apparatus according to claim 1, wherein the abnormality determination unit is configured to calculate the first variation range obtained before change of the operating cycle from a detection value detected by the airflow meter during opening or during closing of the purge control valve.

3. The evaporated fuel treatment apparatus according to claim 1, wherein the abnormality determination unit is configured to calculate the second variation range obtained after change of the operating cycle from a detection value detected by the airflow meter by setting a guard value of a duty ratio of the purge valve and setting the operating cycle 1.5 to 2.5 times longer than the initial set value.

4. The evaporated fuel treatment apparatus according to claim 1, wherein the abnormality determination unit is configured to determine that the abnormality exits in the purge passage when a difference between the second variation range and the first variation range is smaller than a first determination value.

5. The evaporated fuel treatment apparatus according to claim 1, wherein the abnormality determination unit is configured to determine that the abnormality exits in the purge passage when a value obtained by dividing the second variation range by the first variation range is smaller than a second determination value.

6. The evaporated fuel treatment apparatus according to claim 4, wherein the abnormality determination unit is configured to decide the first determination value based on a duty ratio of the purge control valve and a rotation speed of the purge pump.

7. An evaporated fuel treatment apparatus comprising:
an airflow meter provided in an intake passage connected to an internal combustion engine;
a vapor passage connected to a fuel tank;
a canister that stores evaporated fuel to be fed from the fuel tank to the vapor passage;
a purge passage connected to the intake passage and the canister;
a purge pump provided in the purge passage; and
a purge control valve provided in a downstream side of the purge pump,
wherein the evaporated fuel treatment apparatus includes an abnormality determination unit configured to determine an abnormality of the purge passage, and
the abnormality determination unit is configured to determine whether the abnormality exists in the purge passage based on a difference between a variation cycle of a detection value detected by the airflow meter and an operating cycle of the purge control valve while maintaining a duty ratio of the purge control valve set according to an operating state of the internal combustion engine.

8. The evaporated fuel treatment apparatus according to claim 7, wherein the variation cycle is an average value of the variation cycle within a predetermined time.

9. The evaporated fuel treatment apparatus according to claim 2, wherein the abnormality determination unit is configured to calculate the second variation range obtained after change of the operating cycle from a detection value detected by the airflow meter by setting a guard value of a duty ratio of the purge valve and setting the operating cycle 1.5 to 2.5 times longer than the initial set value.

10. The evaporated fuel treatment apparatus according to claim 5, wherein the abnormality determination unit is configured to decide the second determination value based on a duty ratio of the purge control valve and a rotation speed of the purge pump.

* * * * *